United States Patent [19]

Pasquini

[11] Patent Number: 4,744,304

[45] Date of Patent: May 17, 1988

[54] RAILWAY TRACK TAMPING MACHINE

[75] Inventor: Sandro Pasquini, La Tour-de-Peilz, Switzerland

[73] Assignee: Kershaw Manufacturing Co., Inc., Montgomery, Ala.

[21] Appl. No.: 5,904

[22] Filed: Jan. 22, 1987

[30] Foreign Application Priority Data

Feb. 18, 1986 [CH] Switzerland ..... 00654/86

[51] Int. Cl.[4] ..... E01B 27/16

[52] U.S. Cl. ..... 104/12

[58] Field of Search ..... 104/10–15

[56] References Cited

U.S. PATENT DOCUMENTS

| | | | |
|---|---|---|---|
| 3,292,558 | 12/1966 | Oville . | |
| 3,625,156 | 12/1971 | Anderson | 104/12 |
| 4,096,806 | 6/1978 | Allmer | 104/12 |
| 4,258,627 | 3/1981 | Theurer | 104/12 |
| 4,598,645 | 7/1986 | Ganz | 104/12 |

FOREIGN PATENT DOCUMENTS

| | | |
|---|---|---|
| 401116 | 4/1966 | Switzerland . |
| 622302 | 8/1977 | Switzerland . |

*Primary Examiner*—Joseph F. Peters, Jr.
*Assistant Examiner*—Stephen P. Avila
*Attorney, Agent, or Firm*—Anthony J. Casella; Gerald E. Hespos

[57] ABSTRACT

The tamping machine is provided with tamping units on which each tamping tool (8) is articulated on a junction lever (26) controlled for work pivoting by a piston-cylinder unit (28) connected to a forced oscillation generator (24).

The tamping tool (8) can be lifted into out-of-use position on the junction lever (26) by means of an intermediate lever (30) driven by a second hydraulic piston-cylinder unit (31), this intermediate lever being connected to said tool by a connecting link (36). In the lowered working position, the articulation (29) of the intermediate lever and the two articulations (34, 35) of the connecting link are aligned and the piston-cylinder unit (31) for the driving of the intermediate lever is abutted at the end of its stroke. As a result, the tamping tool (8) constitutes the equivalent of a rigid tool with respect to the transmission of the tamping and forced-oscillation forces.

4 Claims, 1 Drawing Sheet

RAILWAY TRACK TAMPING MACHINE

The object of the present invention is a railway track tamping machine having a rolling chassis equipped, for each of the two lines of rails, with at least one tamping unit comprising a frame connected to the rolling chassis, a tool holder which is movable vertically on the frame, at least two junction levers which oscillate and pivot in opposition in a vertical plane parallel to the track and are articulated on the tool holder, a forced oscillation generator installed on the tool holder, at least two tamping tools in the form of levers each articulated on one of the two junction levers and each having at least one pick with tamping tappet pick intended to plunge into the ballast on one side of a tie by the lowering of the tool holder, these two tamping tools oscillating and pivoting in opposition to each other in a vertical plane parallel to the track in working position and being raisable individually into out-of-use position above the travel plane of the track by pivoting in said same plane, and two hydraulic piston-cylinder units each articulated to one of the two junction levers in order to transmit the forced oscillations to the two tamping tools and control their pivoting in working position.

One known tamping machine of this type, designed to tamp the track in all its conformations, that is to say both on the open line and along the switch gear such as points and crossings, is described in Swiss Pat. No. 401 116.

In this known tamping machine, each junction lever articulated on the tool holder and on which a tamping tool is articulated is directly connected to an eccentric shaft of the forced oscillation generator. Each of the two hydraulic piston-cylinder units is connected between the junction lever and the tamping tool in order to control the pivoting of the latter both in its tamping stroke in lowered working position and in is lifting stroke into out-of-use position above the travel plane of the track. These pivoting movements are obtained by deformation of the triangle the three vertices of which are formed, one by the articulation of the tamping tool on the junction lever and the other two by the two end articulations of the hydraulic piston-cylinder unit, one of which is on the tool and the other on the junction lever. This same hydraulic piston-cylinder unit transmits to the tamping tool the forced oscillations to which the junction lever is subjected, as a function of the position of the articulation of the tamping tool with respect to that of this junction lever on the tool holder.

This arrangement has the advantage of requiring only a single drive member in order to assure both the tamping pivoting stroke of the tool into working position and the raising thereof into position out of use. It also has the advantage of not requiring, upon the tamping of a track switch, the lifting of the assembly of the tamping tools by the rising of the tool holder when only one of them need be lifted into position out of operation in order to avoid an obstacle located below it, this in particular when said tool is located within the track. In fact, in the space between the two lines of rails of the track and at the lever of the tamping units, most tamping machines bear longitudinal wires which form part of a device for checking the alignment of the track; as the plane of pivoting of the tool for the placing thereof out of use is vertical and also longitudinal there is no danger of coming against these wires upon this maneuver.

On the other hand, the use of one and the same hydraulic piston-cylinder unit to assure both the tamping pivoting stroke of the tool and the stroke for the lifting thereof into the out-of-use position along one and the same path has the result that the work of this piston-cylinder unit is too great to be able to assure said tool the rigidity necessary and sufficient for its penetration into the ballast and its action of tamping by compression with forced oscillations. In the said patent there is, it is true, an embodiment in which the hydraulic piston-cylinder unit is replaced by a jack with motorized screw but this system, while it makes it possible to avoid the phenomenon of compressibility of the oil of a piston-cylinder unit, is however difficult and not reliable in this particular use, the driving device and the transmission of such a jack being subject to excessively great accelerations and the masses in movement being substantial.

In a method of creating tamping forces and transmitting forced oscillations by hydraulic piston-cylinder unit, the aforementioned drawbacks have the result that this tamping machine cannot attain the performance of a tamping machine which is specifically designed for open-line tamping and which is equipped for this purpose with rigid tamping tools which cannot be folded into the plane of development of these forces and of these oscillations.

Another known tamping machine with tools which can be lifted into position out of use which is of a different type does not have all of these drawbacks due to the fact that the picks of its tamping tools, which are made liftable for this purpose, are liftable in a vertical plane transverse to the track and therefore in a plane perpendicular to the plane of the development of the tamping forces and of the forced oscillations. This tamping machine, which is intended also for tamping on the open line and in switches, is described in Swiss Pat. No. 622 302. In this tamping machine, the raisable pick of a tamping tool is fastened on an intermediate support which is articulated to the pivoting and oscillating lever of said tool on a horizontal pivot longitudinal to the track, and a hydraulic piston-cylinder unit which rests on this lever is provided in order to pivot it in said transverse plane perpendicular to the plane of the development of the tamping forces and the forced oscillations.

The lever of each tamping tool this constituted is connected directly by a hydraulic piston-cylinder unit to an eccentric of the forced oscillation generator and this piston-cylinder unit has only the function here of assuring the pivoting of the tool over the relatively small path necessary to compress the ballast with forced oscillations, the lifting stroke of the retractable pick taking place in a different plane and by means of a different piston-cylinder unit.

On the other hand, however, this design has the drawback that there is the risk of the raisable pick encountering lateral obstacles upon the placing of it out of use, which makes it necessary that the operator, on each occasion, must first inspect the direct surroundings before carrying out this operation.

In case of a lateral obstacle such as, for instance, the one already indicated, consisting of the wires of a device for checking the track alignment in the case of the inner tools, the operator has no other solution than to first of all lift all of the tamping tools above the plane occupied by said wires by raising the tool holder, before he can cause the tool which is to be placed out of use to pivot laterally. This problem is even more difficult to solve when the inner tool in question has two picks juxtaposed in the transverse direction of the track and fastened on the same pivoting support, as shown in said patent in order to illustrate one particular embodiment.

As to the placing out of use of tools on the outside of the track by this manner of lateral lifting, it is noted that the ends of the picks which have thus been lifted are beyond the plumb line of the ends of the ties of the track, in a region where they can therefore enter into conflict with obstacles which are present there in a position outside the travel gauge.

The object of the present invention is to impart to a tamping machine of the type first described on which the tamping tools can be lifted into the out-of-use position in the plane of the development of the tamping forces and of the forced oscillations, a tamping performance on the open track which is comparable to that of a tamping machine equipped with rigid tools, and which does not have the drawbacks of the tamping machines mentioned above in connection with the tamping of switches.

For this purpose, the tamping machine of the invention is characterized by the fact that each junction lever is connected by one of the two hydraulic piston-cylinder units to the forced oscillation generator and has a first horizontal pivot transverse to the track which is remote from its articulation, on which pivot an intermediate lever is articulated, by the fact that the intermediate lever is connected to a drive device for controlling its pivoting having two end-of-stroke positions which is fastened to the junciton lever and that it has a second horizontal pivot transverse to the track remote from the first pivot, by the fact that the tamping tool articulated to the junction lever has a third horizontal pivot transverse to the track remote from its articulation, by the fact that the tamping tool and the intermediate lever are connected by a connecting link articulated at one end on the second pivot and on the other end on the third pivot, and by the fact that in one end-of-stroke position of the driving means for controlling the pivoting of the intermediate lever the three pivots are aligned and the tamping tool is immobilized on the junction lever in the lowered working position while in the other end-of-stroke position of said drive means the tamping tool is immobilized on the junction lever in the raised out-of-use position.

In this way, in the lowered working position, the tamping tool is rigidly immobilized on the junction lever, the alignment of the three pivots producing the effect of a rigid stop of bi-directional effect placing the drive means for the control of the pivoting of the intermediate lever out of the circuit of the transmission of the tamping forces and the forced oscillations.

The hydraulic piston-cylinder unit for the control of the pivoting of the junction lever to which the tamping tool is articulated does not have to assume the lifting of this tool and is working stroke is limited to the tamping stroke of the tool in its lowered working position.

By the combination of these facts, in the lowered working position the tamping tool and the junction lever together constitute the equivalent of a rigid tool, and the performance of the tamping machine of the invention is thus the same on the open track as that of a tamping machine with rigid tools which is specifically intended for that purpose.

On its part, the drive means for the control of the pivoting of the intermediate lever need merely now and again supply the minimum amount of work necessary for lifting the tool into the out-of-use position and temporarily holding it in this position. Therefore this drive means can be of reduced dimensions and of small weight.

For the tamping of switches, the tamping machine of the invention avoids the drawbacks inherent in the mode of lifting the tamping tool in a plane transverse to the track, for which there is the risk of encountering lateral obstacles, while it retains the same performance of the tamping tools lowered into working position as for tamping on the open line.

These effects satisfy the desired purpose in a surprisingly simple and reliable manner.

Other advantages obtained on basis of this basic concept will become evident from the description which follows.

The accompanying drawing shows, by way of example, one embodiment of the tamping machine of the invention.

Figure 1:
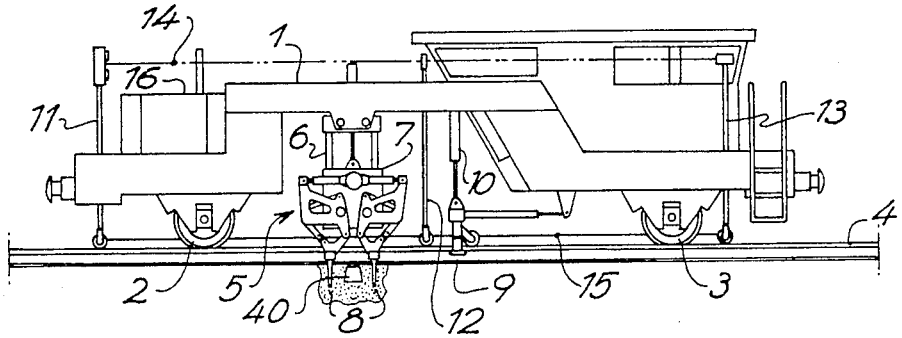
FIG. 1 is an overall side view.

The tamping machine shown as a whole in FIG. 1 is suitable for the tamping, leveling and aligning of railway tracks, both on the open line and in switches.

This tamping machine comprises:

a rolling chassis 1 having two axles 2 and 3, shown here resting on the rails 4 of a railway track;

one tamping unit 5 per rail line, arranged between the two axles 2 and 3 and comprising a frame 6 suspended from the rolling chassis 1 and a tool holder 7 movable vertically in the frame and bearing pivoting and oscillating tamping tools 8;

a device 9 for the shifting of the track connected to the rolling chasis 1 by jacks 10 which control the vertical and transverse shifting;

a device for checking the geometry of the track, represented diagrammatically here by three rail feelers 11, 12 and 13, bearing at their upper end a level-measuring baseline 14 comprising a light beam and at their bottom a track alignment baseline with wires 15 stretched along and between the two lines of rails.

All the force systems of this tamping machine are fed by a power plant 16.

Aside from the tamping unit 5 which is specific to the invention the equipment indicated may be of any known type suitable for the purposes set forth.

It is pointed out here that tamping machines of this type, which have already been described at length in specialized articles, make it possible to lift and shift the track upon their advance so as to bring it, or return it, to its required position by means of the shifting device 9, under the control of the level and alignment baselines and to consolidate the position thus obtained by tamping the ballast by compression and vibrations under the ties by means of the tamping tools 8.

The tamping operation is carried out step by step, in this case tie 40 by tie 40, in accordance with a cycle of operations of predetermined amplitudes comprising a vertical plunging of the tamping tools on both sides of a tie, the partial closing of them around said tie and then their opening again and ascent to above the upper level of the tie, and finally the advancing of the tamping machine by one step for the next cycle.

In order to permit tamping in sections occupied by switches, the tamping units 5 of some of these tamping machines have, like the tamping machine of the invention, tamping tools 8 which are adapted to be placed out of use individually by lifting them above the level of the travel surface of the track when an obstacle located plumb with them prevents the plunging of one or more of them.

Figure 2:
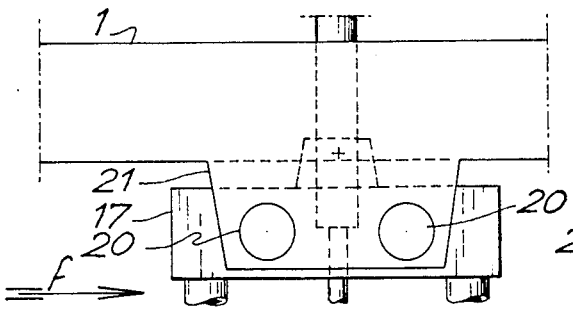
FIG. 2 is a detailed side view, in partial vertical section, of the tamping unit which characterizes it.

The frame 6 of the tamping unit shown in FIGS. 1 and 2 is in the form of a vertical frame formed of an upper cross member 17 and a lower cross member 18, connected at their ends by two parallel cylindrical columns 19 along which the tool holder 7 is mounted for vertical displacement by translation.

The upper cross member 17 of this frame is displaceable transversely to the track by translation along two horizontal cylindrical slideways 20 borne by two brackets 21 which are rigidly attached to the frame 1, only one of which is visible.

Figure 3:
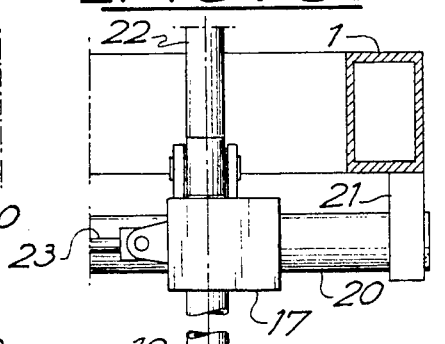
FIG. 3 is a partial front view, in the direction indicated by the arrow f in FIG. 2, of this tamping unit.
Figure 3:
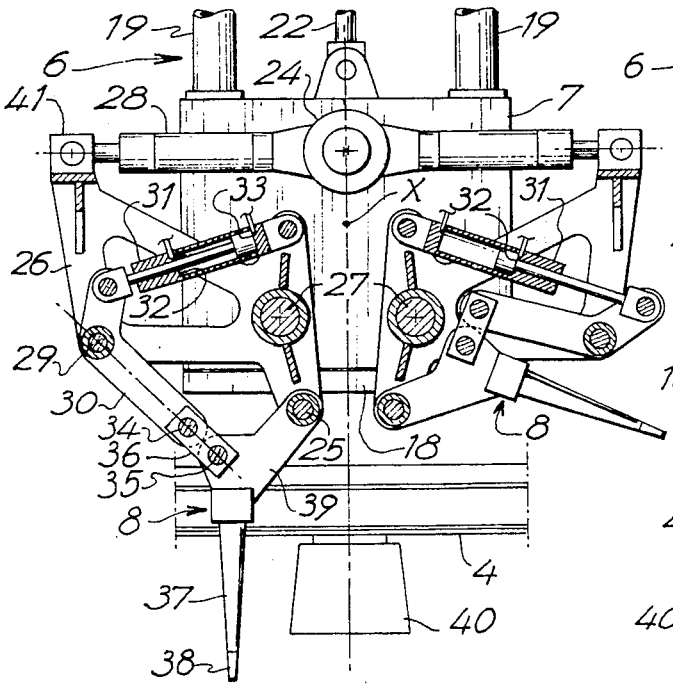
Figure 3:
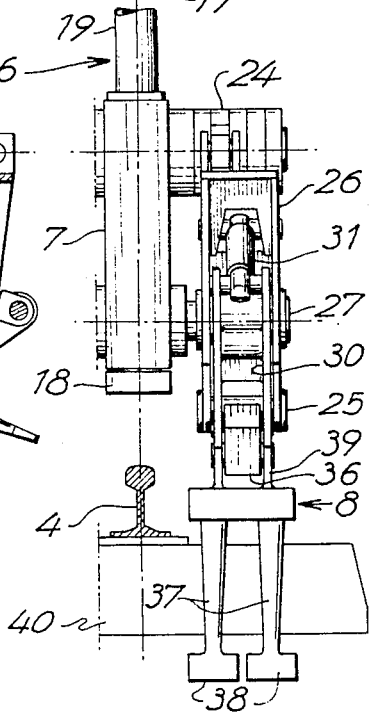

The vertical displacement of the tool holder 7 in the frame 6 is controlled by a hydraulic piston-cylinder unit 22, while the transverse displacement of the frame 6 on the slideways 20 is controlled by another hydraulic piston-cylinder unit, only the rod 23 of which is visible in FIG. 3.

The tool holder 7 comprises two pairs of tamping tools which are arranged symmetrically with respect to the plumb line of the line of rails 4, a single pair of which, formed of two tools 8, is shown in the drawing, the other pair, located on the other side of the tool holder, being identical.

A forced oscillation generator with eccentric output shaft 24 is installed on the tool holder.

The two tools 8 of each pair are mounted for pivoting and oscillating in opposition to each other in a vertical plane parallel to the track in an arrangement symmetrical with respect to the central vertical axis X of one side of the tool holder 7 in which each of them is mounted for pivoting on a horizontal shaft 25, transverse to the track, which is borne by a junction lever 26.

The junction lever 26 is articulated, pivoting in a vertical plane parallel to the track, on a shaft 27 borne by the tool holder 7; this junction lever is connected at its end 41 opposite the shaft 25 to an eccentric of the eccentric shaft 24 via a double-acting hydraulic piston-cylinder unit 28 and has a first horizontal pivot 29 transverse to the track remote from its articulation shaft 27.

An intermediate lever 30 is articulated on the first pivot 29 and is controlled for pivoting around this pivot by a hydraulic piston-cylinder unit 31 arranged resting against the junction lever 26, with two ends of stroke formed by the two limitations 32 and 33 of its fluid chamber, and it has a second horizontal pivot 34 transverse to the track remote from the first pivot 29.

The tamping tool 8 articulated on the junction lever 26 has a third horizontal pivot 35 transverse to the track, remote from its articulation shaft 25.

A junction connecting link 36 is articulated at one end to the second pivot 34 of the intermediate lever 30 and at the other end to the third pivot 35 of the tamping tool 8.

In this arrangement, the geometry of the levers and the stroke of the piston-cylinder unit 31 are determined in such a manner that, in accordance with the teaching of the invention, when the piston-cylinder unit 31 for controlling the pivoting of the intermediate lever 30 is in its retracted end-of-stroke position 33, shown in the left-hand part of FIG. 2, the tamping tool 8 is in lowered working position and the three pivots 29, 34 and 35 are aligned, while in the other end-of-stroke position 32 of this same piston-cylinder unit 31 the tamping tool 8 is lifted into out-of-use position above the level of the travel surface of the track, as shown in the right-hand part of this same FIG. 2.

On basis of this FIG. 2 it is easy clearly to understand the blocking effect of the tamping tool 8 in the lowered working position by the alignment of the three pivots 29, 34 and 35 which is obtained in the end-of-stroke position of the piston-cylinder unit 31 and which places this piston-cylinder unit out of the circuit for the transmission of the tamping forces and forced oscillations, as already mentioned.

In the structure shown, the tamping tool 8 is formed of two picks 37 with tamping tappets 38, juxtaposed in the transverse direction of the track and fastened on a lever 39 having two braced parallel walls between which one end of the connecting link 36 is articulated. The intermediate lever 30 also ahs two braced parallel walls at the same distance apart as those of the lever 39 of the tool 8 and between which the other end of the connecting link 36 is articulated. Finally, the junction lever 26 has two braced walls between which the lever 39 of the tamping tool 8, the intermediate lever and its piston-cylinder unit 31 for the controlling of the pivoting are articulated.

In this way the resultant of the tamping and forced oscillations forces transmitted to the tamping tool 8 passes through the plane of symmetry of these levers and their articulations, which makes it possible to design a structure of minimum weight.

Changes can, of course, be made in the geometry and arrangment of the junction lever 26, the intermediate lever 30 and the lever 39 of the tamping tool 8 while respecting the conditions set forth above relative to the three pivots 29, 34 and 35 and the ends of stroke 32 and 33 of the piston-cylinder unit 31.

However, in order to obtain minimum weight of the suspended and articulated parts of this arrangement, attention is directed to the fact that the geometry applied here results in a minimum size in the longitudinal direction of the track. This size does not, either in lowered position or in raised position of the tamping tools 8, exceed the maximum lengthwise development of the two piston-cylinder units 28 which control the pivoting of the two junctions levers 26 which, it is recalled here, provide only the work necessary for the tamping, over a relatively reduced stroke of these tools. This minimum size is obtained by the fact that the two articulations 25 of the two tamping tools 8 are offset with respect to the plumb line of the picks 37 of these two tools in vertical position towards the center line X and towards the bottom of the tool holder 7. This offset position of these articulations makes it possible in fact to reduce the overall length of each tamping tool 8, measured from its articulation 25 to the end of its tappets 38, to less than one-half the said size of the maximum extended development of the two piston-cylinder units 28.

It should also be pointed out, along a different line, that this minimum size of the tamping unit in the longitudinal direction of the track is advantageous with respect to the organizing of the space reserved for the other tools, particularly those of the track-shifting device 9, and for the feeler 12 of the control device, which must be as close as possible to the zone of action of the tamping tools 8.

Other changes can be made without going beyond the scope of the invention.

Thus each tamping tool 8 may have only one pick 37 with a tappet 38 of a width equivalent to the two tappets shown, this total width being that contemplated for tamping on the open line.

The tool holder 7 may have only a single pair of tools intended to tamp on only one side of a line of rails, in which case the tamping machine has two independent tool holders per line of rail, the frames of which are mounted displaceable transversely to the track by pivoting, as in the case of certain known tamping machines.

The tamping tools which act on the same side of a tie and are located on opposite sides of a rail line may be articulated on a single pivoting and oscillating system rather than two, controlled in pivoting by a single piston-cylinder unit 28 per tie side.

Due to the small amount of work required from the hydraulic piston-cylinder unit 31 for controlling the lifting of the tamping tool 8 into position out of use, this piston-cylinder unit can, without drawback, be replaced by a motorized screw piston-cylinder jack.

Despite the additional advantage resulting from the design of the levers 26, 30 and 39 with double walls, the object of the invention is also obtained with a single wall design having offset articulations of these levers, at the expense, however, of an increase in the overall weight.

Finally, the invention is applicable both to tamping machines in which the tamping units are displaceable both in the transverse and the longitudinal directions of the track, and to those on which the tamping units are not displaceable in these two directions, the invention being not subject to these details.

What is claimed is:

1. A railway track tamping machine for tamping ballast adjacent each of two rail lines, said machine comprising a rolling chasis equipped for each of the two rail lines with at least one tamping unit comprising a frame connected to the rolling chassis, a tool holder (7) which is movable vertically on the frame, at least two junction levers which oscillate and pivot in opposition in a vertical plane parallel to the respective rail and are articulated on the tool holder, a forced oscillation generator installed on the tool holder, at least two tamping tools in the form of levers (39), each articulated on one of the two junction levers and each having at least one tamping tappet pick intended to plunge into the ballast on one side of a tie by lowering of the tool holder, these two tamping tools oscillating and pivoting in opposition to each other in a vertical plane parallel to the respective rail in working position and individually raisable into out-of-use position above the rails by pivoting in said same plane, and two hydraulic piston-cylinder units each articulated to one of the two junction levers in order to transmit the forced oscillations to the two tamping tools and control their pivoting into working position, wherein each junction lever (26) is connected by one of the two hydraulic piston-cylinder units (28) to the forced oscillation generator and has a first horizontal pivot (29) transverse to the track and remote from its articulation (27), on which pivot (29) there is articulated an intermediate lever (30), wherein the intermediate lever is connected to a drive device (31) which controls its pivoting and has two end-of-stroke positions (32, 33), which drive device is fastened to the junction lever, and comprises a second horizontal pivot (34) transverse to the track and remote from the first pivot; wherein the tamping tool (8) articulated to the junction lever comprises a third horizontal pivot (35) which is transverse to the track and remote from its articulation (25); wherein the tamping tool and the intermediate lever are connected by a connecting link which (36) is articulated at one end on the second pivot (34) and at the other end on the third pivot (35); and wherein in one end-of-stroke position of the drive device controlling the pivoting of the intermediate lever said three pivots (29, 34, 35) are aligned and the tamping tool is immobilized on the junction lever in the lowered working position while in the other end-of-stroke position of said drive device the tamping tool is immobilized on the junction lever in its raised, out-of-use position.

2. A tamping machine according to claim 1, wherein the lever (39) of each tamping tool (8) and the intermediate lever (30) have two parallel walls between the connecting link (36) is articulated; and wherein the junction lever (26) also has two parallel walls between which the lever (39) of the tamping tool and the intermediate lever (30) are articulated and between which the drive device (31) for controlling the pivoting of said intermediate lever is located.

3. A tamping machine according to claim 1, wherein the drive device controlling the pivoting of the intermediate lever (30) is a hydraulic piston-cylinder unit (31) the two limits of the fluid chamber of which constitute the two ends of stroke (33) of said pivot control.

4. A tamping machine according to claim 1, wherein the two articulations (25) of the two tamping tools (8) are disposed such that when these two tools are in vertical positions, the articulations (25) are both intermediate vertical extensions of the two tamping tools (8).

* * * * *